US010155395B2

(12) United States Patent
Hara et al.

(10) Patent No.: US 10,155,395 B2
(45) Date of Patent: Dec. 18, 2018

(54) INK CIRCULATION DEVICE AND INKJET RECORDING DEVICE

(71) Applicant: TOSHIBA TEC KABUSHIKI KAISHA, Shinagawa-ku, Tokyo (JP)

(72) Inventors: Kazuhiro Hara, Numazu Shizuoka (JP); Yoshiaki Kaneko, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 121 days.

(21) Appl. No.: 15/417,387

(22) Filed: Jan. 27, 2017

(65) Prior Publication Data

US 2017/0291426 A1 Oct. 12, 2017

(30) Foreign Application Priority Data

Apr. 7, 2016 (JP) ..... 2016-077228

(51) Int. Cl.
*B41J 2/175* (2006.01)
*B41J 2/18* (2006.01)
*B41J 2/19* (2006.01)

(52) U.S. Cl.
CPC ..... *B41J 2/18* (2013.01); *B41J 2/175* (2013.01); *B41J 2/17563* (2013.01); *B41J 2/17596* (2013.01); *B41J 2/19* (2013.01)

(58) Field of Classification Search
CPC .... B41J 2/04586; B41J 2/04588; B41J 2/175; B41J 2/17509; B41J 2/17563;
(Continued)

(56) References Cited

U.S. PATENT DOCUMENTS 4,476,472 A * 10/1984 Aiba ..... B41J 2/17503 347/86
6,007,193 A * 12/1999 Kashimura ..... B41J 2/1707 347/18
(Continued)

FOREIGN PATENT DOCUMENTS

EP 2050572 4/2009
JP 2010-208275 9/2010
(Continued)

OTHER PUBLICATIONS

European Office Action for European Patent Application No. 17159402.1 dated May 25, 2018.

*Primary Examiner* — Anh T. N. Vo
(74) *Attorney, Agent, or Firm* — Amin, Turocy & Watson LLP

(57) ABSTRACT

In accordance with an embodiment, an ink circulation device comprises an ink supply section, an ink return section, an ink circulation pump, a filter and a bypass section. The filter partitions an upstream side ink flow path arranged between an ejection section of the ink circulation pump and the ink supply section into a first flow path communicating with the ejection section of the ink circulation pump and a second flow path communicating with the ink supply section. The bypass section is arranged at the upper part of a vertical direction with respect to the filter, directly communicates the first flow path with a downstream side ink flow path arranged between the ink return section and a suction section of the ink circulation pump. An inkjet recording device of the present embodiment comprises the foregoing ink circulation device.

20 Claims, 5 Drawing Sheets

(58) Field of Classification Search
CPC ... B41J 2/17596; B41J 2/18; B41J 2/19; B41J 2202/12
See application file for complete search history.

(56) References Cited

U.S. PATENT DOCUMENTS

| | | | | |
|---|---|---|---|---|
| 6,039,442 | A * | 3/2000 | Hagiwara | B41J 2/06 347/89 |
| 6,454,401 | B2 * | 9/2002 | Naniwa | B41J 2/06 347/89 |
| 8,128,212 | B2 | 3/2012 | Katada et al. | |
| 2009/0102879 | A1 | 4/2009 | Katada et al. | |

FOREIGN PATENT DOCUMENTS

| | | |
|---|---|---|
| JP | 2010-214693 | 9/2010 |
| JP | 2016-150571 | 8/2016 |

* cited by examiner

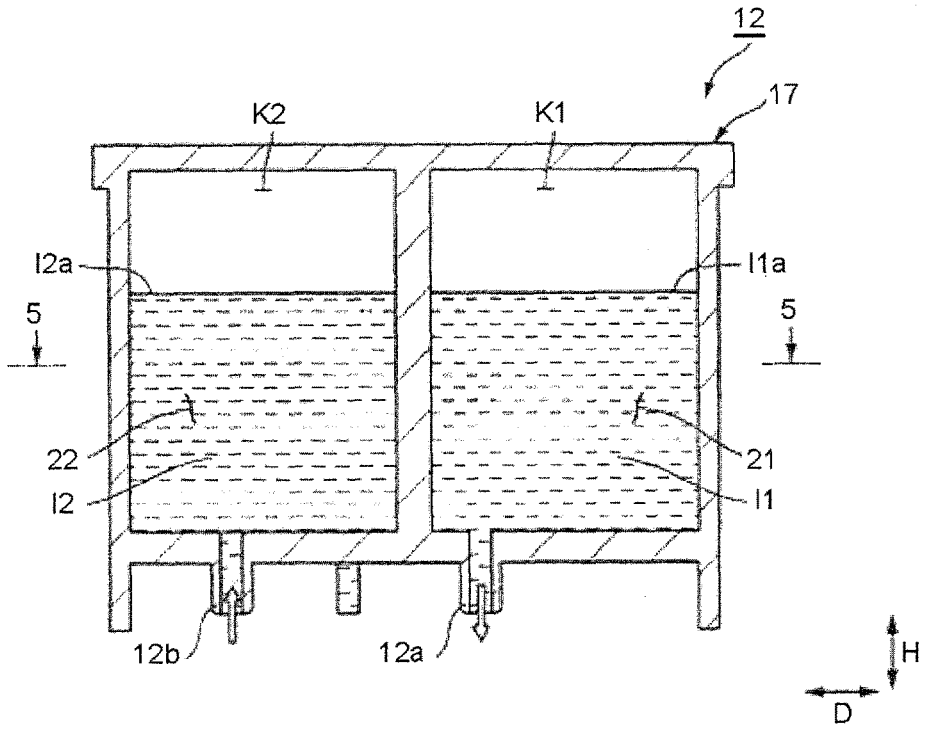
FIG.5
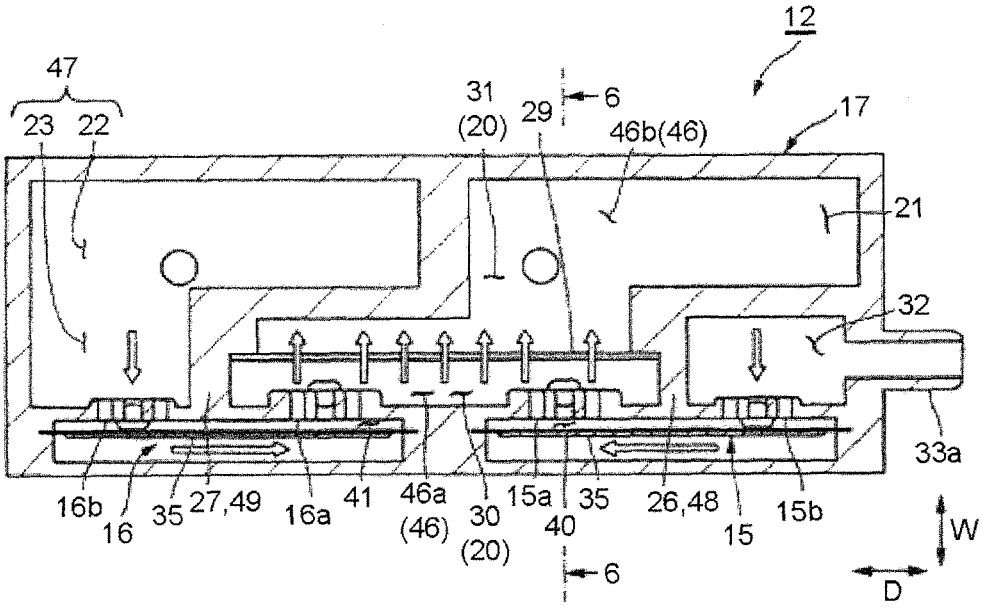

INK CIRCULATION DEVICE AND INKJET RECORDING DEVICE

CROSS-REFERENCE TO RELATED APPLICATIONS

This application is based upon and claims the benefit of priority from Japanese Patent Application No. P2016-077228, filed Apr. 7, 2016, the entire contents of which are incorporated herein by reference.

FIELD

Embodiments described herein relate generally to an ink circulation device and an inkjet recording device.

BACKGROUND

In an inkjet recording device including an ink circulation type inkjet head, ink circulates without staying in the vicinity of nozzles. Thus, deterioration of the ink and precipitation of a color material can be prevented, and ejection stability of the ink can be improved. In recent years, the inkjet head and an ink circulation device can be integrally connected and unitized, and compactification is achieved. However, in order to realize miniaturization of the device, in a case of adopting a piezoelectric pump as an ink circulation pump, small bubbles generate easily in a pressure chamber of the piezoelectric pump of which pressure is fluctuated at high frequency. The bubbles contained in the ink are circulated together with the ink in the inkjet head and the ink circulation device.

If bubbles enter the ink pressure chamber in the inkjet head, pressure for ejecting an ink droplet is decreased, and ejection failure results. In order to prevent this undesired result, an air trap filter for catching the bubbles contained in the ink is arranged at an ejection side of the piezoelectric pump in the ink circulation device. In this way, bubbles in the ink are accumulated in a space at the upstream side of the filter.

However, the volume of the space at the upstream side of the filter becomes small as well when miniaturizing the device, the bubbles trapped in the filter readily accumulate at the upstream side of the filter in a relatively short time.

If air is accumulated at the upstream side of the filter, a contact area of the ink and the filter becomes small, and a flow rate per unit area passing through the filter is increased. As a result, pressure loss of the filter becomes large, and the circulation flow rate of ink is reduced. Furthermore, if the contact area of the ink and the filter becomes small, the pressure loss of the filter becomes large. If the pressure at the upstream side of the filter exceeds bubbles point pressure which is generated when air passes through the filter, the bubbles in the ink passes through the filter together with the ink, the ejection failure due to the bubbles is generated.

DESCRIPTION OF THE DRAWINGS

FIG. 4 is a cross-sectional view of the ink circulation device taken along a 4-4 line in FIG. 3 according to the embodiment;

FIG. 5 is a cross-sectional view equivalent to FIG. 3 showing the flow of ink of the ink circulation device of the embodiment;

DETAILED DESCRIPTION

In accordance with an embodiment, an ink circulation device comprises an ink supply, an ink return section, an ink circulation pump, a filter and a bypass section. The ink supply supplies ink to nozzles of an inkjet head. The ink return section returns ink which is not ejected by the nozzles. The ink circulation pump is arranged between the ink supply and the ink return section. The filter partitions an upstream side ink flow path arranged between an ejection section of the ink circulation pump and the ink supply into a first flow path communicating with the ejection section of the ink circulation pump and a second flow path communicating with the ink supply, and catches bubbles in the ink in the first flow path. The bypass section is arranged at the upper part of a vertical direction with respect to the filter, directly communicates the first flow path with a downstream side ink flow path arranged between the ink return section and a suction section of the ink circulation pump.

An inkjet recording device of the present embodiment comprises the foregoing ink circulation device, an inkjet head comprises nozzles, and a conveyance section configured to convey an image receiving medium to a print position of the inkjet head.

Hereinafter, an ink circulation device 12 and an inkjet recording device 1 of an embodiment are described with reference to the accompanying drawings.

Figure 1:
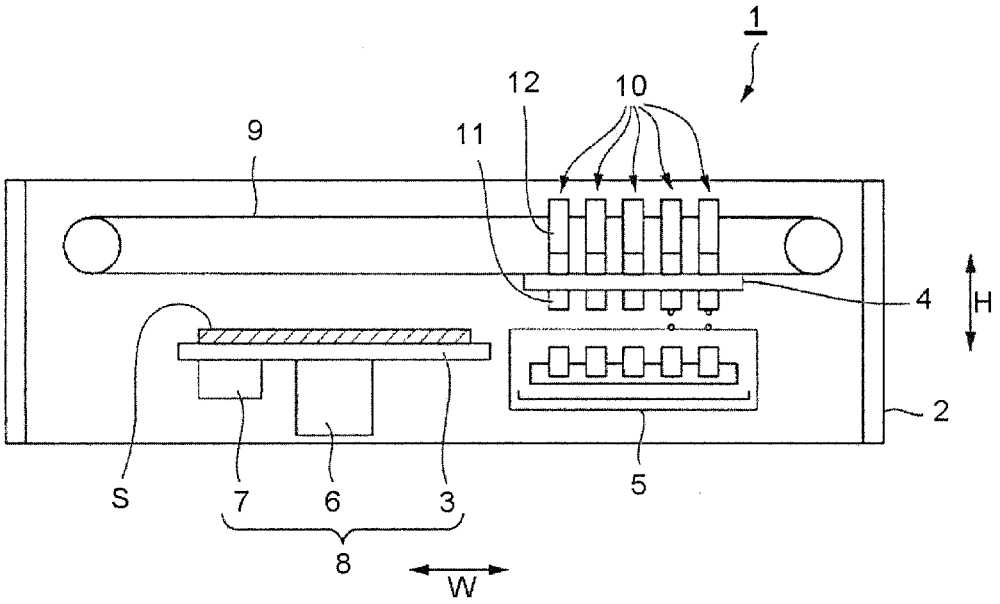
FIG. 1 is a front view schematically illustrating an inkjet recording device including an ink circulation device according to an embodiment.

As shown in FIG. 1, the inkjet recording device 1 of the present embodiment includes a feed table 3, a carriage 4 and a maintenance unit 5 in a casing 2. The feed table 3 is slidably held by a guide rail for feeding 6 arranged in the casing 2. The guide rail for feeding 6 linearly extends in a substantially horizontal direction. The feed table 3 is moved in a direction along the guide rail for feeding 6 by a feed motor (not shown). A negative pressure generating device 7 for absorbing and fixing a sheet-like image receiving medium S such as a sheet on the feed table 3 is arranged on the feed table 3. A conveyance section 8 for conveying the image receiving medium S to a print position of an inkjet head 11 described later is constituted by the feed table 3, the guide rail for feeding 6, the feed motor and the negative pressure generating device 7. Furthermore, the image receiving medium S is not limited to the sheet, and may be a resin film or a metal film, or a wooden plate.

The carriage 4 is slidably held by a guide rail for scanning (not shown) arranged in the casing 2. The guide rail for scanning linearly extends in a substantially horizontal direction orthogonal to the guide rail for feeding 6. The carriage 4 is moved in a direction along the guide rail for scanning by a conveyance belt 9 which is driven by a scanning motor (not shown). In the carriage 4, a plurality of inkjet units 10 is loaded. The plurality of the inkjet units 10 is arranged along a scanning direction of the carriage 4.

Figure 2:
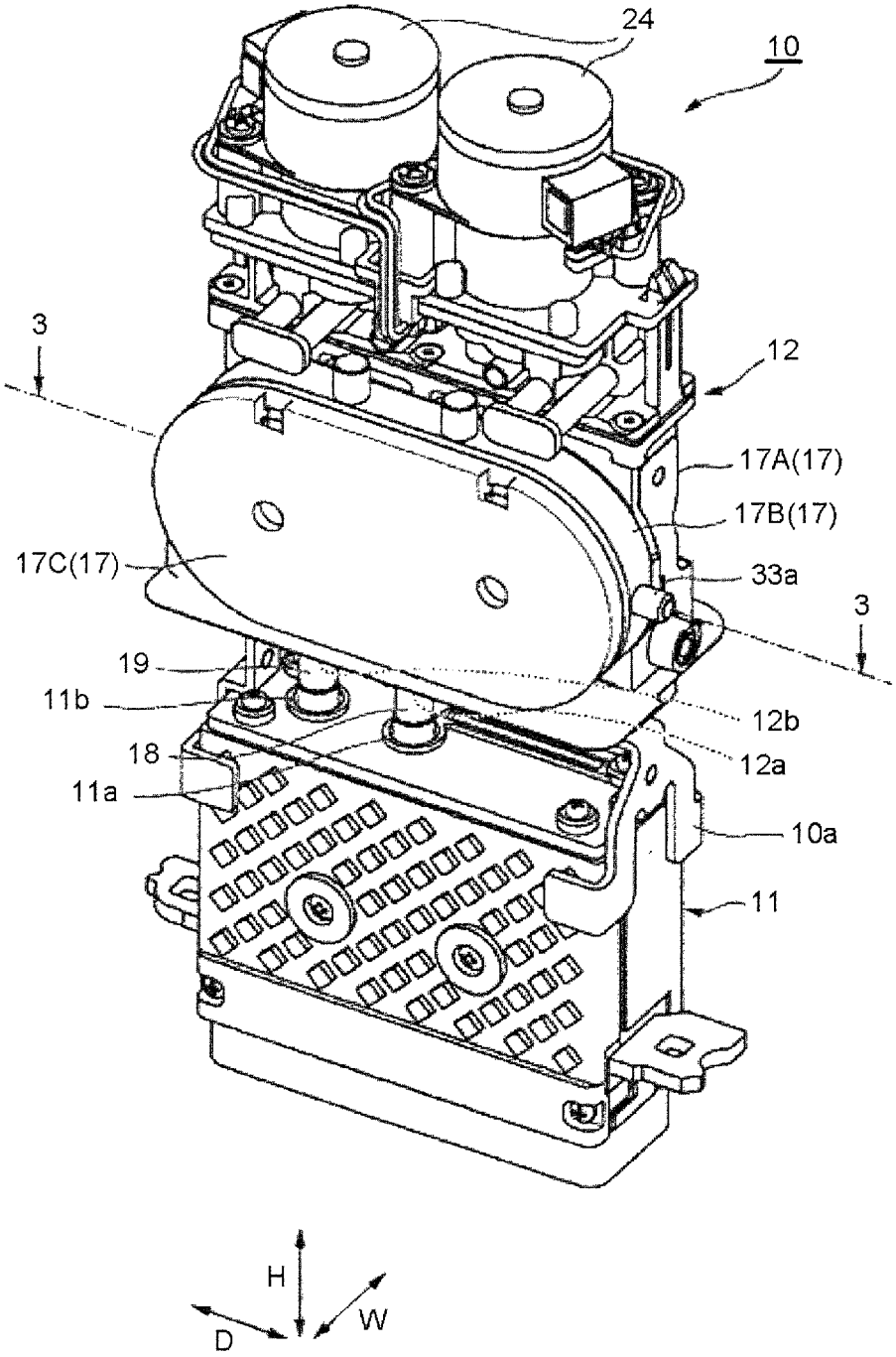
FIG. 2 is a perspective view illustrating an inkjet unit including the ink circulation device according to the embodiment.

With reference to FIG. 2 at the same time, each inkjet unit 10 is provided with an inkjet head 11 for ejecting ink to the image receiving medium S and the ink circulation device 12 of the present embodiment which is combined with the inkjet head 11 at the upper part side of the inkjet head 11. Each inkjet unit 10 is arranged depending on the type of ink ejected to the image receiving medium S. The ink ejected from each inkjet unit 10 is transparent gloss ink or special ink that develops a color when irradiated with infrared rays or ultraviolet rays in addition to ink with different colors such as cyan, magenta, yellow, black and white. Ink cartridges (not shown) are respectively connected with the ink circulation devices 12 of all the inkjet units 10.

The plurality of the inkjet units 10 is collectively arranged on the carriage 4, and moves together with the carriage 4 along the guide rail for scanning. The carriage 4 moves in a range crossing with a moving track of the feed table 3 when the ink is ejected from the inkjet head 11 to the image receiving medium S on the feed table 3. The carriage 4 is stopped at a standby position deviated from the moving track of the feed table 3 when the ejection of the ink from the inkjet head 11 is not carried out.

The maintenance unit 5 covers an ejection section (nozzles) of ink of each inkjet head 11 to prevent evaporation of the ink when the plurality of the inkjet units 10 returns to the standby position together with the carriage 4. The maintenance unit 5 suitably cleans a contact portion with the image receiving medium S of the inkjet head 11 when the plurality of the inkjet units 10 returns to the standby position.

The inkjet head 11 is provided with a plurality of nozzle (not shown) for ejecting the ink, an actuator (not shown) arranged to face the plurality of the nozzles, an ink pressure chamber (not shown) arranged between the plurality of the nozzles and the actuator, an ink introduction section 11*a* communicating with the ink pressure chamber and capable of introducing the ink, and an ink discharge section 11*b* communicating with the ink pressure chamber and capable of discharging the ink which is not ejected from the nozzles to an external device.

The actuator of the inkjet head 11 is constituted by, for example, a piezoelectric vibrating membrane using piezoelectric ceramic. The structure of the actuator is not limited to this structure, and may be other structures as long as pressure of the ink can be increased according to an input signal.

The inkjet recording device 1 according to the embodiment properly moves the carriage 4 which is loaded with the plurality of the inkjet units 10 and the feed table 3 on which the image receiving medium S is placed linearly in a case in which printing corresponding to the input signal is carried out on the image receiving medium S. At this time, according to the input signal to the plurality of the inkjet units 10, the actuator of the inkjet head 11 increases the pressure of the ink, jets the ink from the plurality of the nozzles and carries out the printing on the image receiving medium S.

In the present embodiment, while the image receiving medium S is absorbed and fixed on the feed table 3 and the feed table 3 is moved in one direction, the plurality of the inkjet units 10 is moved in a direction orthogonal to the moving direction of the feed table 3, and the printing corresponding to the input signal is carried out on the image receiving medium S. Furthermore, the image receiving medium S and a feeding method of the image receiving medium S are not limited to these. For example, a roll-type image receiving medium like a rolled paper is used, and while the image receiving medium is drawn out from the roll, an image may be formed on this image receiving medium with the inkjet head 11. Further, while sheet-like image receiving mediums S are fed one by one by a platen roll, an image may be formed on the image receiving medium with the inkjet head 11.

As shown in FIG. 2, the inkjet unit 10 includes the ink circulation device 12 which circulates the ink in this inkjet head 11 above the ink circulation-type inkjet head 11. The inkjet head 11 and the ink circulation device 12 are integrally connected with each other to constitute the inkjet unit 10. The inkjet head 11 and the ink circulation device 12 are connected strongly and mechanically by a connection member 10*a* made of metal. In this way, at the time the ink circulation device 12 and the inkjet head 11 are loaded on the carriage 4, it is possible to carry out strong fixation which endures high-speed movement of the carriage 4 by only fixing mounting of the inkjet head 11 on the carriage 4. Further, by integrating the inkjet head 11 and the ink circulation device 12 to constitute the inkjet unit 10, an ink suction and discharge pipe between the inkjet head 11 and the ink circulation device 12 is simplified. A replenishment tube (not shown) for feeding the ink to the ink circulation device 12 from the ink cartridge and a power supply wiring are connected with the inkjet unit 10.

The ink circulation device 12 is provided with a casing 17, an ink supply tube 18, an ink return pipe 19, a pump unit 25 and a pressure adjustment section 24. The casing 17 is entirely formed into an almost rectangular shape. In a state in which the inkjet unit 10 is loaded on the carriage 4, a dimension of the casing 17 in a width direction W coincident with the scanning direction of the carriage 4 is smaller than dimensions of the casing 17 in a depth direction D coincident with the feeding direction of the feed table 3 and in a height direction H. Furthermore, the inkjet head 11 is also formed into the same rectangular shape, and thus, the dimension in the width direction W of inkjet unit 10 is suppressed.

The ink supply tube 18 supplies the ink from the ink circulation device 12 to the inkjet head 11, and extends downwards from the lower end of the casing 17.

The ink return pipe 19 returns the ink from the inkjet head 11 to the ink circulation device 12, and extends downwards from the lower end of the casing 17.

The pump unit 25 is provided with an ink replenishment pump 15 described later which is capable of replenishing the ink from an external device to the casing 17, and an ink circulation pump 16 described later which circulates the ink between the ink circulation device 12 and the inkjet head 11.

The pressure adjustment section 24 adjusts pressure inside the casing 17 to suitably maintain the pressure of the ink in the nozzles of the inkjet head 11. The pressure adjustment section 24 is arranged at the upper end of the casing 17.

Figure 3:
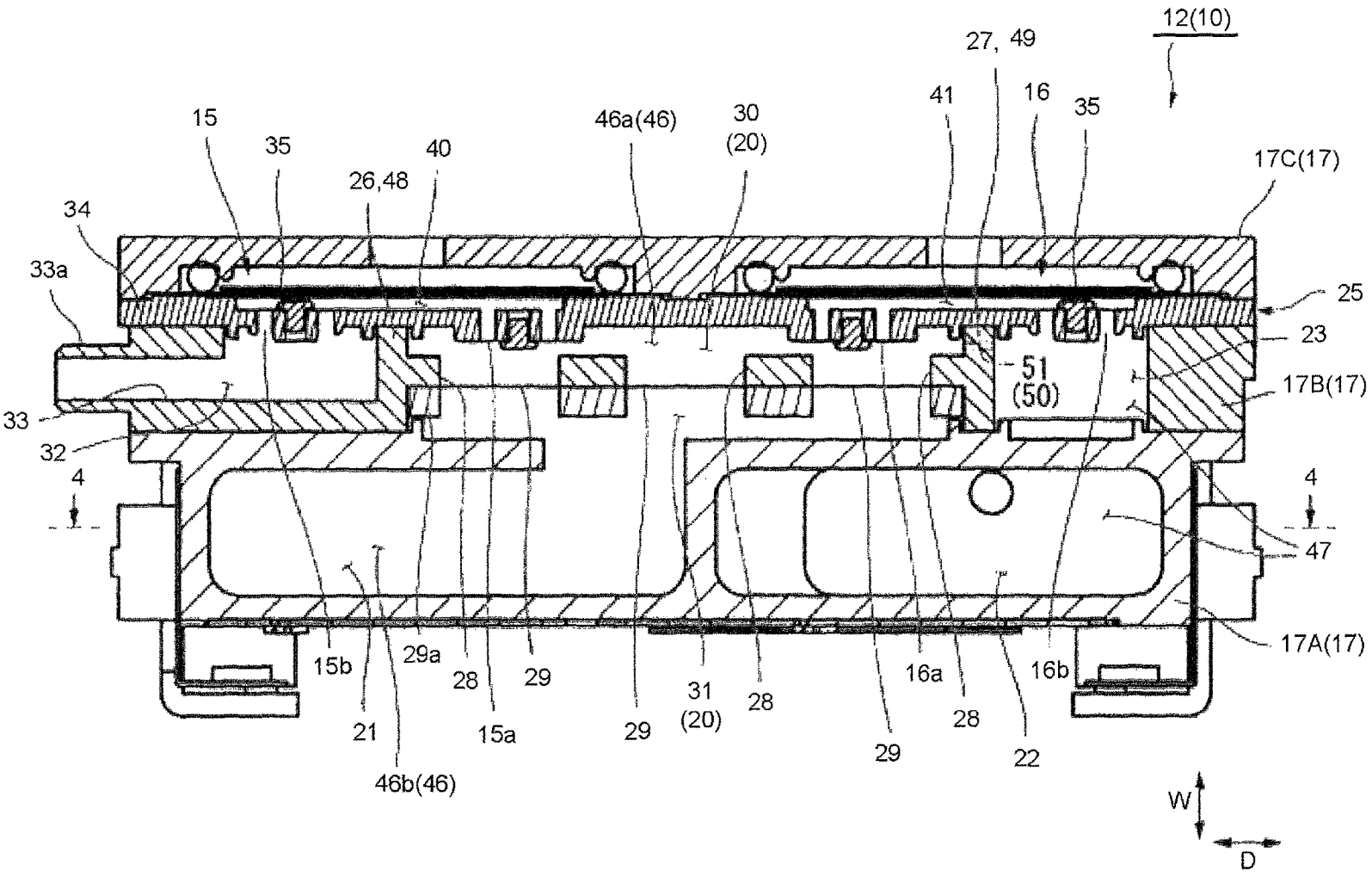
FIG. 3 is a cross-sectional view of the ink circulation device taken along a 3-3 line in FIG. 2 according to the embodiment.

With reference to FIG. 3 at the same time, the casing 17 includes a casing main body 17A for forming a supply side ink chamber 21 and a collection side ink chamber 22, and a flat pump unit case 17B combined with one side surface in the width direction W of the casing main body 17A. The casing 17 further includes a unit cover 17C for blocking a side surface of the pump unit case 17B opposite to the casing main body 17A side. The unit cover 17C and the pump unit case 17B sandwich the pump unit 25 therebetween.

Each member of the casing 17 is formed with, for example, PPS (Polyphenylene Sulfide). Furthermore, the casing 17 may be formed with a resin material such as polyimide, ABS (Acrylonitrile Butadiene Styrene), epoxy resin and polycarbonate in addition to PPS as long as the material does not deteriorate the ink. The casing 17 may also be formed with a metal material (pure metal or a material including alloys) such as aluminum, stainless steel and brass in addition to synthetic resins.

The supply side ink chamber 21 and the collection side ink chamber 22 are arranged in parallel in the casing main body 17A in the depth direction D. An ink supply section 12*a* connected with the ink supply tube 18 is formed at the lower end of the supply side ink chamber 21. An ink return section 12*b* connected with the ink return pipe 19 is formed at the lower end of the collection side ink chamber 22.

Front view of the pump unit case 17B is formed into a substantially elliptical shape long in the depth direction D. In the pump unit case 17B, the inside of the peripheral wall is partitioned into three areas by a first partition wall 26 and a second partition wall 27 extending in a height direction H. Three communication sections 28 are formed at a central area of the pump unit case 17B which is sandwiched by the first partition wall 26 and the second partition wall 27. The three communication sections 28 form a communication port in a range inclined to the lower part side in the height direction H of the pump unit case 17B.

The flat pump unit 25 is arranged at the side surface of the pump unit case 17B opposite to the casing main body 17A side. The pump unit 25 is provided with a base plate 34 which is overlapped with the side surface of the pump unit case 17B in such a way as to face the side surface of the pump unit case 17B, and the ink replenishment pump 15 and the ink circulation pump 16 which are arranged in parallel on the base plate 34 in the depth direction D.

The central area of the pump unit case 17B forms an ejection chamber 20 together with the pump unit 25 and the casing main body 17A. Ejection sections 15*a* and 16*a* of both pumps 15 and 16 of the pump unit 25 face the ejection chamber 20. A filter 29 for catching the bubbles in the ink is mounted on the three communication sections 28 of the pump unit case 17B.

The filter 29 is an air trap filter, for example, a thin film-shaped metal filter which is arranged with a plurality of holes with a diameter of about 10 μm or less. Furthermore, the filter 29 may be a metal mesh, or a membrane filter made of resin. Further, the filter 29 is also called the air trap filter, but certainly, also captures a foreign substance such as rubbish in the ink.

The bubbles in the ink ejected by both pumps 15 and 16 are caught by the filter 29 before arriving at the supply side ink chamber 21. The filter 29 is fixed in the pump unit case 17B by a frame-shaped holder 29*a* which face fringe portions of the three communication sections 28 of the pump unit case 17B.

The pump unit 25 is arranged at the middle of a route from the ink return section 12*b* and the ink replenishment section 33 to the ink supply section 12*a*. The pump unit 25 is mounted on one side surface in the width direction W of the casing 17 together with the pump unit case 17B.

The ink replenishment pump 15 absorbs the ink corresponding to an amount consumed by printing and a maintenance operation from the ink cartridge and replenishes the absorbed ink to the casing 17.

The ink circulation pump 16 absorbs the ink from the collection side ink chamber 22, and sends the absorbed ink to the ejection chamber 20 and the supply side ink chamber 21.

The pumps 15 and 16 each are, for example, piezoelectric element pumps, and change the volume of the pressure chamber at a highspeed to suck and pump the ink through drive of a vibration film at about 50 Hz to 200 Hz which is bent due to distortion of the piezoelectric element. The pumps 15 and 16 each are formed into a flat shape for suppressing the thickness in the width direction W, and suppress enlargement in the width direction W of the ink circulation device 12.

The piezoelectric pump can be made overwhelmingly small compared with a general diaphragm pump, a piston pump and a tube pump as a large drive source such as a motor or a solenoid is not required, which is its advantage. However, from a feature that a piezoelectric actuator changes the volume of the pressure chamber at a high speed, the ink and air are violently collided with each other in the pressure chamber, and it is easy for the piezoelectric pump to acquire the bubbles in the ink. Further, according to a drive condition of the piezoelectric actuator, there are times when cavitation occurs in the pressure chamber, and gas dissolved in the ink appears as bubbles. In this manner, in a case of adopting the piezoelectric pump in each pump, in order to remove small bubbles generated in the pressure chamber of the piezoelectric pump of which pressure is fluctuated at high frequency, it is preferred to arrange the air trap filter 29 at the outlet of the piezoelectric pump.

As shown in FIG. 3-FIG. 5, in the casing 17, the supply side ink chamber 21 and the collection side ink chamber 22 for storing the ink are arranged. The supply side ink chamber 21 and the collection side ink chamber 22 are arranged in parallel to each other in the depth direction D. Ink I1 which flows into from the ejection chamber 20 is stored in the supply side ink chamber 21. The ink I1 in the supply side ink chamber 21 is supplied to the inkjet head 11 via the ink supply tube 18. Ink I2 which returns from the inkjet head 11 via the ink return pipe 19 is stored in the collection side ink chamber 22.

The ejection chamber 20 communicates with the supply side ink chamber 21. The ejection chamber 20 is adjacent to an inner side part in the depth direction D of each of the ink chambers 21 and 22 in the width direction W. A non-return valve at the ejection side of each of the pumps 15 and 16 faces the ejection chamber 20.

In the casing 17, a suction chamber 23 which faces the non-return valve at the suction side of the ink circulation pump 16 is arranged. The suction chamber 23 is adjacent to an outer side part in the depth direction D of the collection side ink chamber 22 in the width direction W. The suction chamber 23 communicates with the collection side ink chamber 22.

In the casing 17, a replenishment chamber 32 which faces the non-return valve at the suction side of the ink replenishment pump 15 is arranged. The replenishment chamber 32 is adjacent to an outer side part in the depth direction D of the supply side ink chamber 21 in the width direction W. In the replenishment chamber 32, the ink replenishment section 33 capable of replenishing the ink from an external device is arranged. A connection nozzle section 33*a* which protrudes towards the outside of the casing 17 is continuously arranged on the ink replenishment section 33. The connection nozzle section 33*a* is connected with the replenishment tube capable of feeding the ink from the ink cartridge to the ink circulation device 12.

The ejection chamber 20 and the replenishment chamber 32 are partitioned by a replenishment side partition wall 48 in the casing 17. The ink arriving at the replenishment chamber 32 is sent to the ejection chamber 20 via the ink replenishment pump 15.

The ejection chamber 20 and the suction chamber 23 are partitioned by a collection side partition wall 49 in the casing 17. The ink arriving at the suction chamber 23 is sent to the ejection chamber 20 via the ink circulation pump 16.

As shown in FIG. 4, air chambers K1 and K2 are formed respectively above the liquid surface of the ink stored in the supply side ink chamber 21 and above the liquid surface of the ink stored in the collection side ink chamber 22. The pressure of the air chambers K1 and K2 in the supply side ink chamber 21 and the collection side ink chamber 22 are detected by respective pressure sensors (not shown). The pressure adjustment section 24 arranged at the upper part of the casing 17 operates and the pressure inside the casing 17 is properly adjusted in response to a detection value of the pressure sensor.

The pump unit 25 includes a pair of piezoelectric vibrating membranes 35 which respectively correspond to the pumps 15 and 16 and are mounted on the surfaces of the unit cover 17C side of the base plate 34. The pair of the piezoelectric vibrating membranes 35 form pump chambers 40 and 41 of the pumps 15 and 16 respectively between the piezoelectric vibrating membranes 35 and the base plate 34. Each piezoelectric vibrating membrane 35 is constituted by mutually binding disc-shaped piezoelectric elements (not shown) and metal plates.

The pumps 15 and 16 each cyclically change the volumes in the pump chambers 40 and 41 to feed the ink as the piezoelectric vibrating membranes 35 each are bent through energization. The pumps 15 and 16 each regulate an ink feed direction to one direction through a pair of non-return valves. In each of the pumps 15 and 16, one non-return valve is arranged in each of suction sections 15*b* and 16*b*, and the other non-return valve is arranged in each of the ejection sections 15*a* and 16*a*. The non-return valves of the suction sections 15*b* and 16*b* regulate the flow of the ink in the suction sections 15*b* and 16*b* to the suction directions to the pump chambers 40 and 41. The non-return valves of the ejection sections 15*a* and 16*a* regulate the flow of the ink in the ejection sections 15*a* and 16*a* to the ejection directions from the pump chambers 40 and 41.

The ink replenishment pump 15 is arranged across the replenishment chamber 32 and the ejection chamber 20 which are adjacent to each other in the depth direction D. The ink replenishment pump 15 enables the suction section 15*b* to face the replenishment chamber 32, and enables the ejection section 15*a* to face the ejection chamber 20.

The ink circulation pump 16 is arranged across the suction chamber 23 and the ejection chamber 20 which are adjacent to each other in the depth direction D. The ink circulation pump 16 enables the suction section 16*b* to face the suction chamber 23, and enables the ejection section 16*a* to face the ejection chamber 20.

The ink cartridge for supplying the ink to the collection side ink chamber 22 is arranged below relatively in the gravity direction with respect to the ink circulation device 12. Water head pressure of the ink in the ink cartridge is kept lower than setting pressure of the collection side ink chamber 22 by arranging the ink cartridge below. Thus, only when the ink replenishment pump 15 is driven, it is possible to supply the ink to the collection side ink chamber 22.

The supply side ink chamber 21 includes a function for moving the bubbles contained in the ink which flows into the supply side ink chamber 21. The bubbles in the ink in the supply side ink chamber 21 rise to the upper part of the vertical direction through buoyancy, reaches the air chamber K1 above the liquid surface and is removed. An air amount of the air chamber K1, for example, is maintained to a setting value through an air bleeding structure at the upper part of the supply side ink chamber 21. Air mixed into the replenishment chamber 32 also flows into the air chamber K1 of the supply side ink chamber 21. Furthermore, the air bleeding structure may be separately mounted at the upper part of the replenishment chamber 32.

Similarly, the collection side ink chamber 22 also includes a function for moving the bubbles contained in the ink which flows into the collection side ink chamber 22, and an air amount of the air chamber K2 is maintained to a setting value. Air mixed into the suction chamber 23 also flows into the air chamber K2 of the collection side ink chamber 22. Furthermore, the air bleeding structure may be separately mounted at the upper part of the suction chamber 23.

Each of the air chambers K1 and K2 of the ink chambers 21 and functions as a damper for absorbing pulsation (pressure fluctuation) caused by the drive of each of the pumps 15 and 16.

Each of the air chambers K1 and K2 of the ink chambers 21 and 22 is filled by air left at the time of initial ink filling; however, it is also possible to perform filling with nitrogen or a rare gas which is difficult to react with the ink except for air. In other words, air in the inkjet unit 10 is replaced with nitrogen or a rare gas before the ink initial filling, and if the ink is supplied to the inkjet unit 10 after the replacement, it is possible to fill the air chambers K1 and K2 with nitrogen or a rare gas.

In the circulation routes of the ink circulation device 12, a flow path in which the ink flows through the ejection sections 15*a* and 16*a* of both pumps 15 and 16, the ejection chamber 20, the supply side ink chamber 21 and the ink supply section 12*a* in order is set as an upstream side ink flow path 46. In the circulation routes of the ink circulation device 12, a flow path in which the ink flows through the ink return section 12*b*, the collection side ink chamber 22, the suction chamber 23 and the suction section 16*b* of the ink circulation pump 16 in order is set as a downstream side ink flow path 47.

The upstream side ink flow path 46 is partitioned into a first flow path 46*a* which communicates with the ejection section 16*a* of the ink circulation pump 16 and a second flow path 46*b* communicates with the ink supply section 12*a* by the filter 29. The ejection chamber 20 is partitioned into an upstream chamber 30 at the first flow path 46*a* side and a downstream side 31 at the second flow path 46*b* side by the filter 29.

Figure 6:
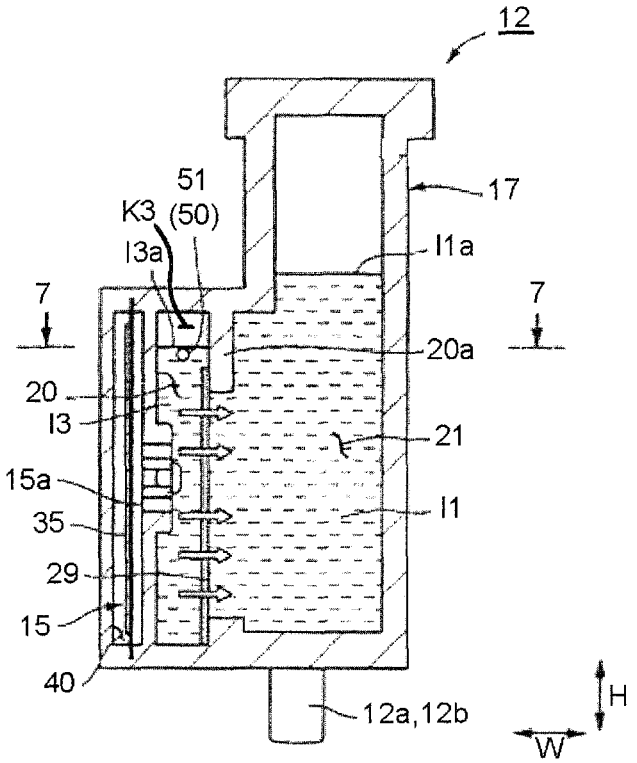
FIG. 6 is a cross-sectional view of the ink circulation device taken along a 6-6 line in FIG. 6 according to the embodiment.
Figure 7:
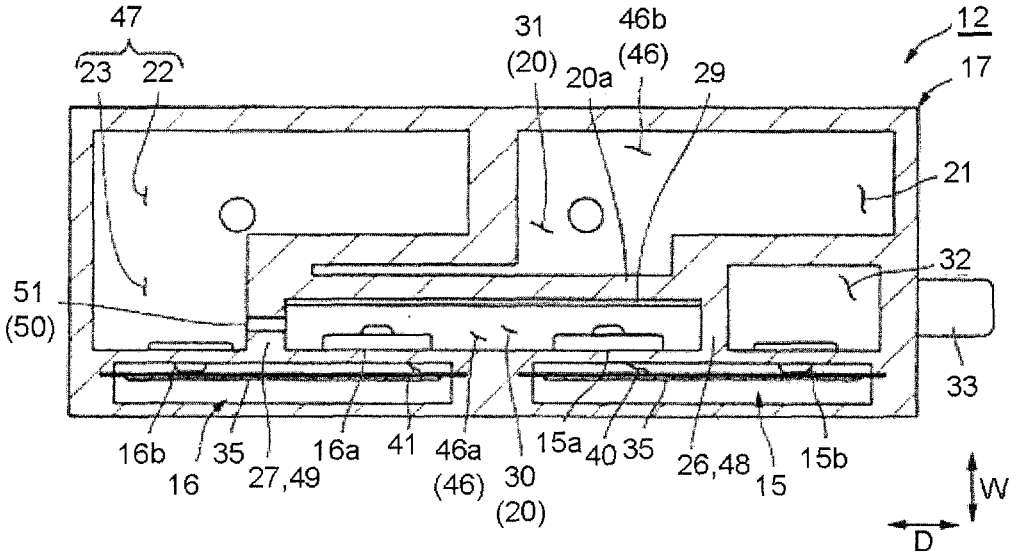
FIG. 7 is a cross-sectional view of the ink circulation device taken along an 8-8 line in FIG. 7 according to the embodiment.

With reference to FIG. 6 and FIG. 7 at the same time, the ink circulation device 12 is provided with a bypass section 50 which directly communicates the first flow path 46*a* with the downstream side ink flow path 47 without passing through the filter 29, the second flow path 46*b* and the inkjet head 11. The bypass section 50 is constituted by, for example, a through hole forming section 51 arranged on the collection side partition wall 49 of the casing 17. The through hole forming section 51 penetrates the upper part of the collection side partition wall 49 between the ejection chamber 20 and the suction chamber 23 to form a through hole for communicating the ejection chamber 20 with the suction chamber 23.

As the first flow path 46*a* and the downstream side ink flow path 47 are adjacent via the collection side partition wall 49, the bypass section 50 can be simply arranged with the through hole. The through hole of the bypass section 50 holds a larger flow path resistance than a flow path resistance of a normal route from the first flow path 46*a* to the downstream side ink flow path 47 via the filter 29, the second flow path 46*b* and the inkjet head 11.

The through hole of the bypass section 50 is positioned at the upper part of the vertical direction with respect to the filter 29. The upper part of the filter 29 is supported by a hanging wall 20*a* which extends downwards from the upper wall of the ejection chamber 20. An air chamber K3 is formed above a liquid surface I3*a* of ink I3 stored in the ejection chamber 20 by the hanging wall 20*a*. In a case in which the height of the lower end of the hanging wall 20*a* is the actual height of the upper end of the filter 29, the through hole forming section 51 may be positioned at the upper part with respect to the lower end of the hanging wall 20*a*.

The through hole forming section 51 of the bypass section 50 is opened directing the depth direction D in the ejection chamber 20. Flow along the depth direction D in the ejection chamber 20 is formed by the ink flowing into the ejection chamber 20 from the bypass section 50. One side surface in the thickness direction (width direction W) of the flat filter 29 faces the inside of the ejection chamber 20. The ink flowing into the ejection chamber 20 from the bypass section 50 flows along the one side surface of the filter 29, and the adhesion of the bubbles to the one side surface is suppressed.

Next, effects of the present embodiment are described.

Firstly, the inkjet recording device 1 moves the inkjet unit 10 through the scanning of the carriage 4 at the time of the printing on the image receiving medium S. The inkjet unit 10 ejects ink corresponding to image data to be printed to the image receiving medium S and forms an image on the image receiving medium S in synchronization with the scanning of the carriage 4.

While the printing on the image receiving medium S is being carried out, the inkjet head 11 circulates the ink through the drive of the ink circulation device 12. In the nozzles of the inkjet head 11, through the drive of the actuator of the inkjet head 11, a part of the circulated ink breaks meniscus (interface of ink and air), and becomes an ink droplet to be ejected.

If the ink is ejected from the inkjet head 11, the amount of the ink in the casing 17 is reduced instantaneously, and the pressure in the collection side ink chamber 22 is reduced. If the pressure sensor detects the reduction of the pressure in the collection side ink chamber 22, the ink replenishment pump 15 is driven, and the ink equivalent to the ejected ink amount is replenished from the ink cartridge to the collection side ink chamber 22.

There are times when the bubbles are mixed into the ink in the casing 17 through the foregoing circulation and replenishment of the ink. The bubbles are caught to the upstream chamber 30 of the ejection chamber 20 by the filter 29, and the flow into the inkjet head 11 is prevented. The bubbles caught by the filter 29 are accumulated in the upstream chamber 30 to become an air layer in the upstream chamber 30. This air layer functions as a damper for absorbing the pulsation caused by the drive of each of the pumps 15 and 16; however, if the liquid surface of the upstream chamber 30 is pressed downwards excessively, the pressure loss of the filter 29 is increased and influence is exerted to the circulation flow rate.

In particular, in a case of reducing the volume of the upstream chamber 30 in front of the filter 29 in order to realize miniaturization of the device, the bubbles trapped by the filter 29 presses the liquid surface downwards in a relatively short time. If the liquid surface of the upstream chamber 30 falls, a contact area of the ink and the filter 29 becomes small, a flow rate per unit area passing through the filter 29 is increased, and the pressure loss of the filter 29 is increased. As a result, a difference between the upstream pressure of the filter 29 and the downstream pressure of the filter 29 exceeds bubbles point pressure which is determined by surface tension of ink at a filter hole, and the upstream air of the filter 29 passes through the filter hole. The air passing through the filter hole continues flowing together with the ink as the bubbles. When the bubbles flowing together with the ink pass through the vicinity of the nozzles of the inkjet head 11, the ejection of the ink becomes unstable.

In the present embodiment, even if the air layer (air chamber K3) accumulated in the upstream chamber 30 presses the liquid surface I3*a* of the ink I3 downwards, at a point of time at which the liquid surface I3*a* falls to some degree, an opening (through hole) of the bypass section 50 positioned at the upper part with respect to the filter 29 exposes the top of the liquid surface I3*a*. In this way, a part of the air of the air layer in the upstream chamber 30 flows out to the downstream side ink flow path 47 (suction chamber 23 in the present embodiment) via the bypass section 50. In this manner, as the air of the air layer in the upstream chamber 30 flows out via the bypass section 50, the liquid surface I3*a* of the ink I3 of the upstream chamber 30 rises, and the opening of the bypass section 50 returns to the lower part of the liquid surface of the ink again.

As rise and fall of the liquid surface is repeated by taking the bypass section 50 as a boundary, the filter 29 is always located at the lower part of the liquid surface of the ink, the contact area of the ink and the filter 29 is not reduced. Thus, the pressure loss of the filter 29 does not become large, and the difference between the upstream pressure of the filter 29 and the downstream pressure of the filter 29 does not exceed the bubbles point pressure. In other words, it is also possible to capture small bubbles, and it is suppressed that the bubbles flows to the downstream side. The air flowing out from the upstream chamber 30, for example, is removed by the air bleeding structure at the upper part of the collection side ink chamber 22.

The bypass section 50 holds a larger flow path resistance than a flow path resistance of a normal route from the upstream chamber 30 to the downstream side ink flow path 47 via the filter 29, the downstream chamber 31 and the inkjet head 11. Thus, even if the opening (through hole) of the bypass section 50 is in the liquid, the amount of the ink directly flowing into the downstream side ink flow path 47 via the bypass section 50 is less, and the circulation flow rate of the ink is maintained.

The liquid surface of the upstream chamber 30 at the upstream side of the filter 29 is always maintained suitably and the pressure loss of the filter 29 is maintained suitably through the bypass section 50. Moreover, as the bypass section 50 forms the flow of the ink along one side surface of the filter 29, the adhesion of the bubbles to the filter 29 is suppressed, and even so, the pressure loss of the filter 29 is maintained suitably.

In this way, the circulation flow rate of the ink is stable, and the upstream pressure of the filter 29 is suppressed to be smaller than the bubbles point pressure, and the mixture of air into the inkjet head 11 is suppressed.

According to at least one embodiment described above, the ink circulation device 12 is provided with the filter 29 and the bypass section 50. The filter 29 partitions the upstream side ink flow path 46 arranged between the ejection section 16*a* of the ink circulation pump 16 and the ink supply section 12*a* into the first flow path 46*a* which communicates with the ejection section 16*a* of the ink circulation pump 16 and the second flow path 46*b* which communicates with the ink supply section 12*a*, and catches the bubbles in the ink in the first flow path 46*a*. The bypass section 50 is arranged at the upper part of the vertical direction with respect to the filter 29, and directly communicates the first flow path 46*a* with the downstream side ink flow path 47 arranged between the ink return section 12*b* and the suction section 16*b* of the ink circulation pump 16.

According to the structure, the bubbles in the ink is removed by the filter 29, the height of the liquid surface at the upstream side of the filter 29 is maintained suitably, the absorption effect of pump pulsation by the air layer is obtained, and the increase of the pressure loss of the filter 29 can be suppressed by reducing the contact area of the ink and the filter 29. In other words, the air accumulated in the front of the filter 29 arranged at the outlet of the ink circulation pump 16 is discharged more efficiently to the bypass section 50 arranged at the upper part with respect to the filter 29, and the whole of the filter 29 can always be contacted with the ink. Thus, the increase of the pressure loss of the filter 29 is suppressed, and the flow rate of the ink is guaranteed, and even if the volume of the space in the front of the filter 29 is reduced in order to realize the miniaturization of the device, the air does not break through the filter 29, and the bubbles are not mixed into the ink. In this manner, it can be suppressed that the circulation flow rate of ink is reduced or the bubbles in the ink passes through the filter 29, and the ejection failure of the ink can be suppressed.

Further, the bypass section 50 holds a larger flow path resistance than a flow path resistance of a normal route from the first flow path 46*a* to the downstream side ink flow path 47 via the filter 29, the second flow path 46*b* and the inkjet head 11, and thus even if the opening (through hole) of the bypass section 50 is in the liquid, the amount of the ink directly flowing into the downstream side ink flow path 47 via the bypass section 50 is suppressed, and the circulation flow rate of the ink is maintained.

Further, as the opening (through hole) facing the inside of the ejection chamber 20 in the bypass section 50 directs the direction along one side surface facing the inside of the ejection chamber 20 in the filter 29, when the bypass section 50 is in the liquid, the bypass section 50 forms the flow of the ink along the one side surface of the filter 29, and the adhesion of the bubbles to the filter 29 can be suppressed. In this case, the flow path resistance of the bypass section 50 may be reduced and the ink may flow positively. An inner diameter relating to the flow path resistance of the bypass section 50 may be properly determined in consideration of the characteristics of the ink and the circulation flow rate at which the ejection of the ink of the inkjet head 11 is stable.

Furthermore, the bypass section 50 of the present embodiment may be constituted by, for example, a pipe member (bypass pipe) which penetrates the collection side partition wall 49. In this case, compared with a case of arranging the bypass section 50 with the through hole forming section 51, the degree of freedom of setting of the bypass section 50 can be enhanced, and the degree of freedom of setting of the height of the liquid surface can be enhanced. The bypass section 50 of the present embodiment forms the flow path which extends in the depth direction D, but may form flow paths which extend in the width direction W and in the height direction H. Further, the bypass section 50 communicates the upstream chamber 30 of the upstream side ink flow path 46 and the collection side ink chamber 22 of the downstream side ink flow path 47.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink circulation device, comprising:

an ink supply for supplying ink to nozzles of an inkjet head;

an ink return section configured to return ink which is not ejected by the nozzles;

an ink circulation pump arranged between the ink supply and the ink return section;

a filter positioned to partition an upstream side ink flow path arranged between an ejection section of the ink circulation pump and the ink supply into a first flow path communicating with the ejection section of the ink circulation pump and a second flow path communicating with the ink supply, and configured to catch bubbles in the ink in the first flow path; and a bypass section arranged at the upper part of a vertical direction with respect to the filter, and configured to directly communicate the first flow path with a downstream side ink flow path arranged between the ink return section and a suction section of the ink circulation pump.

2. The ink circulation device according to claim 1, wherein the ink circulation pump is a piezoelectric pump for driving a piezoelectric actuator with a piezoelectric element.

3. The ink circulation device according to claim 1, further comprising:

an ink replenishment pump connected with the first flow path and capable of replenishing ink from an ink tank to the first flow path, wherein the ink replenishment pump is a piezoelectric pump for driving a piezoelectric actuator with a piezoelectric element.

4. The ink circulation device according to claim 2, further comprising:

an ink replenishment pump connected with the first flow path and capable of replenishing ink from an ink tank to the first flow path, wherein the ink replenishment pump is a piezoelectric pump for driving a piezoelectric actuator with a piezoelectric element.

5. The ink circulation device according to claim 1, wherein the bypass section holds a larger flow path resistance than a flow path resistance of a route from the first flow path to the downstream side ink flow path via the filter, the second flow path and the inkjet head, and directly communicates the first flow path with the downstream side ink flow path.

6. The ink circulation device according to claim 1, wherein an opening forming section facing the first flow path in the bypass section directs a direction along a surface facing the first flow path in the filter.

7. The ink circulation device according to claim 1, wherein the ink circulation pump comprises a pair of piezoelectric vibrating membranes.

8. The ink circulation device according to claim 1, wherein the filter comprises a metal sheet with holes, a metal mesh, or a resin membrane.

9. An inkjet recording device, comprising:

an ink circulation device;

an inkjet head comprising nozzles; and a conveyance section configured to convey an image receiving medium to a print position of the inkjet head, wherein the ink circulation device comprising:

an ink supply for supplying ink to nozzles of an inkjet head;

an ink return section configured to return ink which is not ejected by the nozzles;

an ink circulation pump arranged between the ink supply and the ink return section;

a filter positioned to partition an upstream side ink flow path arranged between an ejection section of the ink circulation pump and the ink supply into a first flow path communicating with the ejection section of the ink circulation pump and a second flow path communicating with the ink supply, and configured to catch bubbles in the ink in the first flow path; and a bypass section arranged at the upper part of a vertical direction with respect to the filter, and configured to directly communicate the first flow path with a downstream side ink flow path arranged between the ink return section and a suction section of the ink circulation pump.

10. The inkjet recording device according to claim 9, wherein the ink circulation pump is a piezoelectric pump for driving a piezoelectric actuator with a piezoelectric element.

11. The inkjet recording device according to claim 9, further comprising:

an ink replenishment pump connected with the first flow path and capable of replenishing ink from an ink tank to the first flow path, wherein the ink replenishment pump is a piezoelectric pump for driving a piezoelectric actuator with a piezoelectric element.

12. The inkjet recording device according to claim 10, further comprising:

an ink replenishment pump connected with the first flow path and capable of replenishing ink from an ink tank to the first flow path, wherein the ink replenishment pump is a piezoelectric pump for driving a piezoelectric actuator with a piezoelectric element.

13. The inkjet recording device according to claim 9, wherein the bypass section holds a larger flow path resistance than a flow path resistance of a route from the first flow path to the downstream side ink flow path via the filter, the second flow path and the inkjet head, and directly communicates the first flow path with the downstream side ink flow path.

14. The inkjet recording device according to claim 9, wherein an opening forming section facing the first flow path in the bypass section directs a direction along a surface facing the first flow path in the filter.

15. An ink circulation method, comprising:

supplying ink to nozzles of an inkjet head;

returning ink which is not ejected by the nozzles;

pumping ink with an ink circulation pump arranged between an ink supply and an ink return section;

filtering bubbles from the ink flowing in a first flow path communicating with an ejection section of the ink circulation pump; and flowing ink through a bypass section arranged at the upper part of a vertical direction with respect to a filter.

16. The ink circulation method according to claim 15, wherein the ink circulation pump is a piezoelectric pump for driving a piezoelectric actuator with a piezoelectric element.

17. The ink circulation method according to claim 15, further comprising:

replenishing ink from an ink tank to the first flow path.

18. The ink circulation method according to claim 16, further comprising:

replenishing ink from an ink tank to the first flow path.

19. The ink circulation method according to claim 14, wherein the ink circulation pump comprises a pair of piezoelectric vibrating membranes.

20. The ink circulation method according to claim 14, wherein the filter comprises a metal sheet with holes, a metal mesh, or a resin membrane.

* * * * *